US008735036B2

(12) United States Patent
Kitajima et al.

(10) Patent No.: US 8,735,036 B2
(45) **Date of Patent: *May 27, 2014**

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventors: Katsuyuki Kitajima, Kanagawa (JP); Yutaka Saito, Kanagawa (JP); Sakon Takahashi, Kanagawa (JP); Michio Take, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/432,918

(22) Filed: Mar. 28, 2012

(65) Prior Publication Data

US 2013/0108949 A1 May 2, 2013

(30) Foreign Application Priority Data

Oct. 26, 2011 (JP) ..... 2011-235332

(51) Int. Cl.
*G03G 9/097* (2006.01)

(52) U.S. Cl.
USPC ..... 430/108.7; 430/108.6; 430/123.51; 399/222

(58) Field of Classification Search
USPC ..... 430/108.6, 108.7, 123.51; 399/222
See application file for complete search history.

(56) References Cited

U.S. PATENT DOCUMENTS

| | | | | |
|---|---|---|---|---|
| 5,422,218 | A | 6/1995 | Tong | |
| 5,837,414 | A | 11/1998 | Kitani et al. | |
| 6,077,635 | A | 6/2000 | Okada et al. | |
| 6,403,271 | B1 | 6/2002 | Suzuki et al. | |
| 7,163,773 | B2 | 1/2007 | Sugiura et al. | |
| 7,169,526 | B2 | 1/2007 | Ishikawa et al. | |
| 7,344,816 | B2 | 3/2008 | Matsumura et al. | |
| 7,611,815 | B2 | 11/2009 | Sugiura et al. | |
| 2002/0048473 | A1 | 4/2002 | Yamada et al. | |
| 2002/0061457 | A1 | 5/2002 | Okuno et al. | |
| 2002/0115008 | A1 | 8/2002 | Suzuki et al. | |
| 2003/0134217 | A1 | 7/2003 | Combes et al. | |
| 2003/0148203 | A1 | 8/2003 | Suzuki et al. | |
| 2003/0219667 | A1 | 11/2003 | Matsumoto et al. | |
| 2004/0197693 | A1* | 10/2004 | Ninomiya et al. | 430/108.7 |

(Continued)

FOREIGN PATENT DOCUMENTS

| | | |
|---|---|---|
| JP | A-6-266152 | 9/1994 |
| JP | A-9-319134 | 12/1997 |

(Continued)

OTHER PUBLICATIONS

Nov. 27, 2012 Office Action issued in Australian Patent Application No. 2012202495.

(Continued)

*Primary Examiner* — Peter Vajda
(74) *Attorney, Agent, or Firm* — Oliff PLC

(57) ABSTRACT

An electrostatic charge image developing toner includes: toner particles; and an external additive having an average particle diameter of from about 70 nm to about 420 nm, an average circularity of equal to or less than about 0.9, and a standard deviation of the circularity of greater than 0.2.

10 Claims, 2 Drawing Sheets

(56) References Cited

U.S. PATENT DOCUMENTS

| | | | | |
|---|---|---|---|---|
| 2005/0164109 | A1 | 7/2005 | Lizuka et al. | |
| 2006/0045571 | A1 | 3/2006 | Matsuura et al. | |
| 2006/0251979 | A1 | 11/2006 | Watanabe et al. | |
| 2007/0009823 | A1 | 1/2007 | Skorokhod et al. | |
| 2007/0042285 | A1 | 2/2007 | Kitani et al. | |
| 2007/0099105 | A1 | 5/2007 | Itoh | |
| 2007/0218387 | A1 | 9/2007 | Ishii et al. | |
| 2007/0274737 | A1 | 11/2007 | Serizawa et al. | |
| 2008/0014527 | A1 | 1/2008 | Kotsugai et al. | |
| 2008/0086951 | A1 | 4/2008 | Wakamiya et al. | |
| 2008/0096116 | A1 | 4/2008 | Utsumi et al. | |
| 2008/0268362 | A1 | 10/2008 | Kudo | |
| 2008/0286668 | A1 | 11/2008 | Ishigami et al. | |
| 2009/0042121 | A1 | 2/2009 | Toizumi et al. | |
| 2009/0123857 | A1 | 5/2009 | Shu et al. | |
| 2009/0196658 | A1 | 8/2009 | Sugiura | |
| 2010/0203443 | A1* | 8/2010 | Okita et al. | 430/124.1 |
| 2010/0233607 | A1 | 9/2010 | Asano et al. | |
| 2011/0097659 | A1 | 4/2011 | Sugiura et al. | |
| 2011/0287355 | A1 | 11/2011 | Udo | |
| 2012/0156601 | A1 | 6/2012 | Kitajima et al. | |
| 2012/0231381 | A1 | 9/2012 | Kitajima et al. | |
| 2012/0237864 | A1 | 9/2012 | Saito et al. | |
| 2013/0071781 | A1 | 3/2013 | Saito et al. | |

FOREIGN PATENT DOCUMENTS

| | | |
|---|---|---|
| JP | A-11-174731 | 7/1999 |
| JP | A-2004-295110 | 10/2004 |
| JP | A-2005-266557 | 9/2005 |
| JP | A-2007-121882 | 5/2007 |
| JP | A-2007-199579 | 8/2007 |
| JP | A-2008-129125 | 6/2008 |
| JP | A-2008-169102 | 7/2008 |
| JP | A-2009-78935 | 4/2009 |
| JP | A-2009-137791 | 6/2009 |
| JP | A-2011-59261 | 3/2011 |
| WO | WO 2006/070871 A1 | 7/2006 |

OTHER PUBLICATIONS

Nov. 21, 2012 Office Action issued in U.S. Appl. No. 13/112,699.
Feb. 1, 2013 Office Action issued in U.S. Appl. No. 13/351,783.
U.S. Appl. No. 13/214,710, filed Aug. 22, 2011 in the name of Yutaka Saito et al.
U.S. Appl. No. 13/214,793, filed Aug. 22, 2011 in the name of Katsuyuki Kitajima et al.
U.S. Appl. No. 13/351,783, filed Jan. 17, 2012 in the name of Yutaka Saito et al.
U.S. Appl. No. 13/112,699, filed May 20, 2011 in the name of Katsuyuki Kitajima et al.
Apr. 11, 2013 Office Action issued in U.S. Appl. No. 13/214,793.
May 31, 2013 Office Action issued in U.S. Appl. No. 13/351,783.
Nov. 21, 2013 Office Action issued in U.S. Appl. No. 13/112,699.
Sep. 20, 2013 Office Action issued in U.S. Appl. No. 13/351,783.
Jul. 26, 2013 Office Action issued in U.S. Appl. No. 13/112,699.
Jul. 29, 2013 Office Action issued in U.S. Appl. No. 13/214,710.
Aug. 7, 2013 Office Action issued in U.S. Appl. No. 13/214,793.
Mar. 11, 2013 Office Action issued in Australian Patent Application No. 2012202495.
Feb. 13, 2014 Office Action issued in U.S. Appl. No. 13/351,783.
Jan. 9, 2014 Office Action issued in U.S. Appl. No. 13/214,710.

* cited by examiner

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-235332 filed Oct. 26, 2011.

BACKGROUND

Technical Field

The present invention relates to an electrostatic charge image developing toner, an electrostatic charge image developer, a toner cartridge, a process cartridge, an image forming apparatus, and an image forming method.

SUMMARY

According to an aspect of the invention, there is provided an electrostatic charge image developing toner including: toner particles; and an external additive having an average particle diameter of from about 70 nm to about 420 nm, an average circularity of equal to or less than about 0.9, and a standard deviation of the circularity of greater than 0.2.

BRIEF DESCRIPTION OF THE DRAWINGS

Exemplary embodiments of the present invention will be described in detail based on the following figures, wherein.

DETAILED DESCRIPTION

Figure 1:
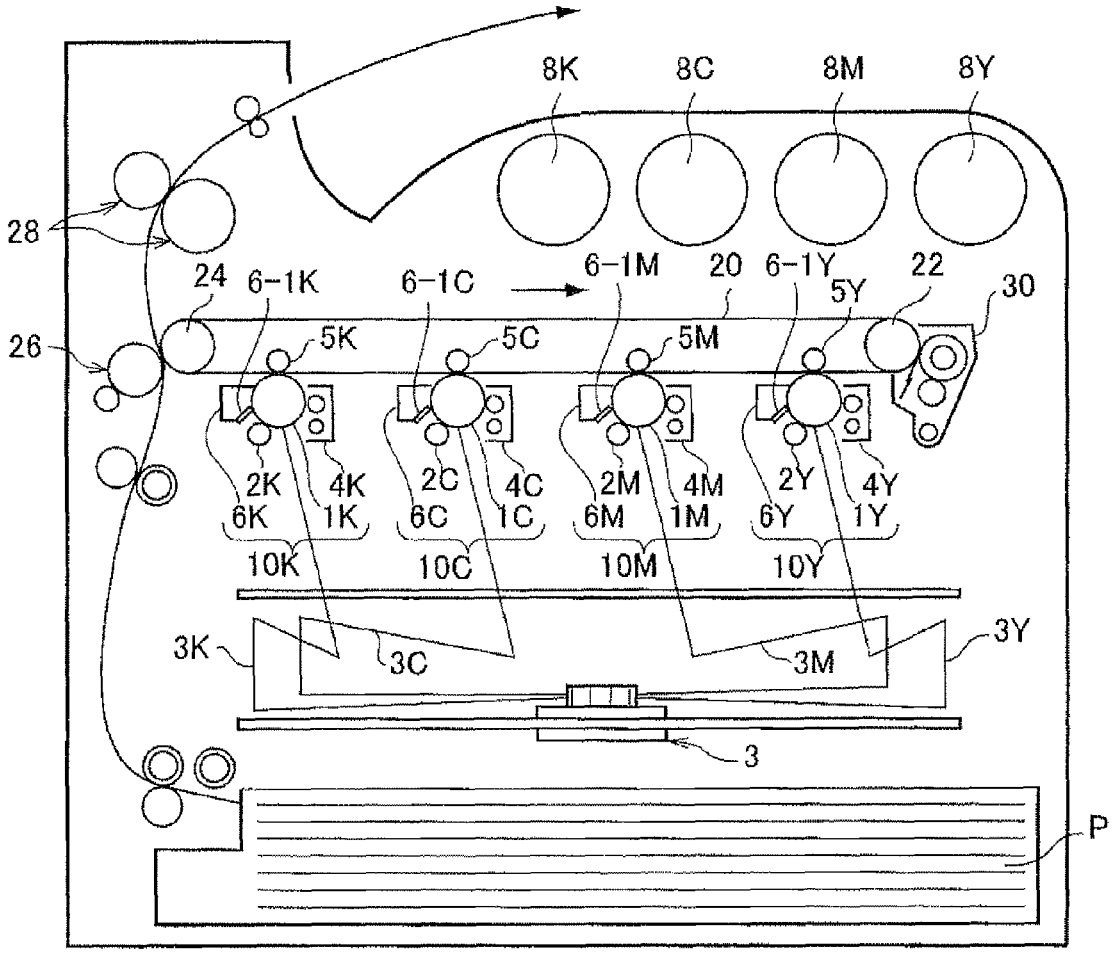
FIG. 1 is a diagram schematically illustrating the configuration of an image forming apparatus according to an exemplary embodiment of the invention.

Hereinafter, an exemplary embodiment of the invention will be described in detail.

Electrostatic Charge Image Developing Toner

An electrostatic charge image developing toner (hereinafter, may be simply referred to as a "toner") according to an exemplary embodiment of the invention includes toner particles and an external additive having an average particle diameter of from 70 nm to 420 nm (or from about 70 nm to about 420 nm), an average circularity of equal to or less than 0.9 (or equal to or less than about 0.9), and a standard deviation of the circularity of greater than 0.2.

The toner according to this exemplary embodiment has the above-mentioned constitution and thus suppresses the generation of a color streak.

Although it is not exactly known, the reason is considered as follows.

First, to prevent an external additive from being embedded in toner particles due to a mechanical load, an external additive of a spherical shape with a large diameter is used. However, the spherical external additive with a circularity close to 1.0 which has been used as an external additive of a toner can easily pass through a cleaning blade, thereby causing the generation of a color streak.

On the other hand, when an external additive is formed in irregular shapes, the cleaning property of the cleaning blade is improved and thus the external additive is prevented from passing through.

However, when a constant pattern image is continuously formed using the external additive having irregular shapes, the image is continuously printed out in a state where the toner particles and the external additive stay in an imaged part in a part where the cleaning blade and an image holding member contact with each other but the toner particles and the external additive do not easily stay in a non-imaged part.

Accordingly, in the part where the cleaning blade and the image holding member contact with each other, areas in which the toner particles or the external additive is present can be unevenly distributed in the axis direction of the image holding member. As a result, an area in which a frictional coefficient is locally raised is generated, thereby generating a color streak.

The color streak is markedly generated particularly when a constant pattern image is continuously formed with a low image density (low area coverage) under a low-temperature and low-humidity environment (for example, at 10° C. and 10% RH).

On the contrary, in the toner according to this exemplary embodiment, an external additive having an average particle diameter of from 70 nm to 420 nm, an average circularity of equal to or less than 0.9, and a standard deviation of the circularity of greater than 0.2, that is, an external additive of irregular shapes with a wide circularity distribution, is used.

Here, the external additive with a wide circularity distribution means an external additive of which the shape irregularity is large, and specifically, an external additive including various external additive particles from particles with a large shape irregularity to particles with a small shape irregularity.

By setting the circularity distribution to be wide, the external additive includes various external additive particles from an external additive (an external additive with a small shape irregularity) that does not easily stay in the cleaning blade and moves to a non-imaged part to an external additive (an external additive with a large shape irregularity) that easily stay in the cleaning blade and does not easily move.

That is, by setting the average circularity of the external additive to be equal to or less than 0.9, the passing through the cleaning blade is suppressed and a part of the external additive moves from an imaged part to a non-imaged part in the part where the cleaning blade and the image holding member come in contact with. Accordingly, in the part where the cleaning blade and the image holding member contact with each other, the external additive can easily stay without being unevenly distributed in the axis direction of the image holding member. As a result, it is thought that the generation of an area in which the frictional coefficient is locally raised is suppressed in the axis direction of the image holding member in the part where the cleaning blade and the image holding member contact with each other.

In this way, the generation of a color streak is suppressed with the toner according to this exemplary embodiment.

With the toner according to this exemplary embodiment, since the generation of an area in which the frictional coefficient is locally raised is suppressed in the part where the cleaning blade and the image holding member contact with each other, it is thought that it is possible to suppress generation of abnormal noise, scratch of the cleaning blade, and a curling of the cleaning blade.

The toner according to this exemplary embodiment will be described below in detail.

External Additive

The external additive will be described first.

An external additive having an average particle diameter of from 70 nm to 420 nm, an average circularity of equal to or less than 0.9, and a standard deviation of the circularity of greater than 0.2 is used as the external additive.

Average Particle Diameter

The average particle diameter of the external additive is preferably in the range of from 70 nm to 420 nm, more preferably in the range of from 100 nm to 300 nm, and still more preferably in the range of from 120 nm to 200 nm.

When the average particle diameter of the external additive is smaller than 420 nm, the elimination thereof with the lapse of time is suppressed, the external additive is easily attached to the toner particles, and the passing thereof through the cleaning blade is suppressed.

On the other hand, when the average particle diameter is equal to or more than 70 nm, the external additive is not easily embedded in the toner particles.

The average particle diameter of the external additive is calculated by observing the surfaces of the toner particles, observing 100 external additives (particles), analyzing images of the observed surfaces of the toner particles through the use of an image processing analysis software WinRoof (made by Mitani Corp.). The average particle diameter of the external additive means the 50% diameter (D50v) in a cumulative frequency of equivalent circle diameters obtained by analyzing images of primary particles.

Average Circularity

The average circularity of the external additive is preferably equal to or less than 0.9, more preferably equal to or less than 0.85, and still more preferably equal to or less than 0.80. When the average circularity of the external additive is equal to or less than 0.9, the shapes of the external additive are irregular and are not spherical. Accordingly, it is thought that the passing thereof through the cleaning blade is suppressed and the generation of a color streak is suppressed.

On the other hand, the average circularity of the external additive is preferably equal to or more than 0.5 (or equal to or more than about 0.5), more preferably equal to or more than 0.60, and still more preferably equal to or more than 0.65. When the average circularity is equal to or more than 0.5, the aspect ratio of the external additive is small and thus the external additive is not easily crushed even with a mechanical load. Accordingly, it is thought that the phenomenon is suppressed in which a color streak is generated since the crushed external additive falls out, for example, from the part where the cleaning blade and the image holding member contact with each other, the toner particles having a hardness lower than that of the external additive and weak to the pressure of the cleaning blade go in place, and the toner particles are crushed by the cleaning blade.

When the average circularity is equal to or more than 0.5, it is easy to produce the external additive.

The average circularity is measured by observing 100 external additive particles at 40000 magnifications and analyzing the images of the observed surfaces of the toner particles through the use of an image processing analysis software WinRoof (made by Mitani Corp.).

The equivalent circle perimeter and the perimeter are calculated from the analyzed images, the circularity of each external additive particle is calculated using the following expression, and the calculated circularity values are averaged (similarly to calculation of the average particle diameter).

$$\text{Circularity}=\text{Equivalent Circle Perimeter/Perimeter}=[2\times(A\pi)^{1/2}]/PM$$

In the expression, A represents a projection area of each external additive particle and PM represents the perimeter of each external additive particle.

If the circularity is 1.0, it means a perfect sphere. As the value thereof becomes lower, more unevenness is present on the circumference and the shape irregularity becomes higher.

Standard Deviation of Circularity

The standard deviation of the circularity of the external additive is preferably greater than 0.2 and more preferably greater than 0.22. Here, since the circularity distribution is preferably wide, the standard deviation of the circularity is preferably high. However, when the standard deviation of the circularity is excessively high, the particles having different circularity values are unevenly distributed and thus the upper limit of the standard deviation of the circularity is set to 0.3.

It is thought that it is possible to suppress the generation of a color streak by setting the standard deviation of the circularity of the external additive to be greater than 0.2.

The standard deviation of the circularity of the external additive is calculated from the circularity values of the respective external additive particles. Specifically, on the basis of the calculated circularity value of the primary particles, the square sum of the differences between the circularity values of the particles and the average circularity is divided by the total number of particles, and the square root of the resultant is then calculated as the standard deviation of the circularity.

Material

The advantage of the toner according to this exemplary embodiment is mechanically based on the average particle diameter, the average circularity, and the standard deviation of the circularity. Accordingly, the material of the external additive is not particularly limited, as long as it satisfies the average particle diameter, the average circularity, and the standard deviation of the circularity, and known materials can be used. The usable materials of the external additive will be described below.

Known external additives such as inorganic particles and organic particles can be used as the external additive. Specific examples of the inorganic particles include various types of particles such as silica (for example, fumed silica and sol-gel silica), alumina, titania, zinc oxide, tin oxide, iron oxide, calcium carbonate, potassium carbonate, tricalcium phosphate, and cerium oxide which are typically used as the external additive of the toner surface. Specific examples of the organic particles include various types of particles such as vinyl resins, polyester resins, silicone resins, and fluorine resins, which are typically used as the external additive of the toner surface. Among these, sol-gel silica is preferabley used.

Method of Producing External Additive

An example of the method of producing an external additive is a sol-gel method.

Hereinafter, the method of producing an external additive using the sol-gel method is referred to as a "method of producing sol-gel silica".

The method of producing sol-gel silica includes a process (hereinafter, also referred to as an "alkaline catalyst solution preparing process") of preparing an alkaline catalyst solution in which an alkaline catalyst with a concentration of 0.6 mol/L to 0.87 mol/L is included in a solvent including alcohol and a process (hereinafter, also referred to as a "particle forming process") of supplying tetraalkoxysilane to the alkaline catalyst solution and supplying an alkaline catalyst of 0.1 mol to 0.4 mol per 1 mol of the total amount of tetraalkoxysilane supplied per minute.

That is, this production method is a method of causing an alkaline catalyst to react with tetraalkoxysilane to form silane particles while independently supplying the tetraalkoxysilane as a raw material and the alkaline catalyst as a catalyst with the above-mentioned relation in the presence of alcohol including the alkaline catalyst with above-mentioned concentration.

According to this method of producing sol-gel silica, it is possible to obtain sol-gel silica with the suppressed generation of coarse aggregates and a low circularity. Although it is not exactly known, the reason is considered as follows.

First, by preparing the alkaline catalyst solution in which an alkaline catalyst is included in a solvent including alcohol and independently supplying tetraalkoxysilane and an alkaline catalyst to the solution, tetraalkoxysilane supplied to the alkaline catalyst solution reacts to form core particles. At this time, when the concentration of the alkaline catalyst in the alkaline catalyst solution is in the above-mentioned range, it is thought that the generation of coarse aggregates such as secondary aggregates is suppressed and core particles having a low circularity are formed. This is because the alkaline catalyst does not only performs a catalyst function but also coordinates with the surfaces of the formed core particles to contribute to shape stability and dispersion stability of the core particles, but the alkaline catalyst of which the amount is in the above-mentioned range does not uniformly cover the surfaces of the core particles (that is, the alkaline catalyst is unevenly attached to the surfaces of the core particles), whereby the dispersion stability of the core particles is maintained but the surface tension and the chemical affinity of the core particles are partially biased to cause the core particles to have a low circularity.

By continuously supplying the tetraalkoxysilane and the alkaline catalyst, the formed core particles grow through the reaction of the tetraalkoxysilane, thereby obtaining silane particles.

Here, by supplying the tetraalkoxysilane and the alkaline catalyst with the supply amounts maintained in the above-mentioned relations, it is thought that the core particles having a low circularity grow with the shape irregularity maintained while suppressing the generation of coarse aggregates such as secondary aggregates, whereby sol-gel silica having a low circularity is generated. This is because the partial bias of the tension and the chemical affinity on the surfaces of the core particles are maintained while maintaining the dispersion of the core particles by supplying the tetraalkoxysilane and the alkaline catalyst with the above-mentioned relations, whereby the core particles grow with the shape irregularity maintained.

Accordingly, according to the method of producing sol-gel silica, it is possible to obtain sol-gel silica with the suppressed generation of coarse aggregates and with a low circularity.

Here, it is thought that the amount of tetraalkoxysilane to be supplied is associated with the particle size distribution or circularity of the sol-gel silica. By setting the amount of tetraalkoxysilane to be supplied to the range of from 0.0055 mol/(mol·min) to 0.009 mol/(mol·min), it is possible to lower the contact probability of the tetraalkoxysilane and the core particles in the particle growing process and to cause the reaction of the tetraalkoxysilane with the core particles before the tetraalkoxysilane is evenly supplied to the core particles. That is, it is thought that the reaction of the tetraalkoxysilane and the core particles is biased. Accordingly, the unevenness in supply of the tetraalkoxysilane to the core particles is promoted to cause the uneven growth of the particles.

As a result, it is possible to produce sol-gel silica in which the average circularity of the sol-gel silica is equal to or less than 0.9 and the standard deviation of the circularity with wide shape irregularity is greater than 0.2.

It is also thought that the average particle diameter of the sol-gel silica depends on the total amount of tetraalkoxysilane to be supplied.

In the method of producing sol-gel silica, since the core particles with shape irregularity are formed and are made to grow with the shape irregularity maintained to produce the sol-gel silica, it is thought that it is possible to obtain the sol-gel silica with shape irregularity having high shape stability under a mechanical load.

That is, in the method of producing sol-gel silica, since the formed core particles with shape irregularity grow with the shape irregularity maintained to obtain the sol-gel silica, it is thought that it is possible to obtain the sol-gel silica which is strong to a mechanical load and is difficult to crush.

In the method of producing sol-gel silica, by independently supplying the tetraalkoxysilane and the alkaline catalyst to the alkaline catalyst solution, the reaction of tetraalkoxysilane is caused to form particles. Accordingly, compared with the case where silica particles with shape irregularity are produced through the sol-gel method according to the related art, it is possible to reduce the total amount of alkaline catalyst of be used and thus to skip the process of removing the alkaline catalyst. This is advantageous when the sol-gel silica is applied to a product requiring high purity.

The alkaline catalyst solution preparing process will be described below.

In the alkaline catalyst solution preparing process, a solvent including alcohol is prepared and an alkaline catalyst is added thereto, thereby preparing an alkaline catalyst solution.

The solvent including alcohol may be a simple solvent including only alcohol or may be a mixture solvent mixed with other solvents such as water, ketones such as acetone, methylethyl ketone, and methylisobutyl ketone, cellosolves such as methylcellosolve, ethylcellosolve, butylcellosolve, and cellosolve acetate, and ethers such as dioxane and tetrahydrofuran.

In case of the mixture solvent, the amount of alcohol relative to the other solvents is equal to or more than 80% by weight (preferably equal to or more than 90% by weight).

Lower alcohols such as methanol and ethanol can be used as the alcohol.

On the other hand, the alkaline catalyst is a catalyst for promoting the reaction of tetraalkoxysilane (such as a hydrolysis reaction and a condensation reaction) and examples thereof include basic catalysts such as ammonia, urea, monoamine, and quarternary ammonium salt. Among these, ammonia can be preferably used.

The concentration (content) of the alkaline catalyst is preferably in the range of from 0.6 mol/L to 0.87 mol/L, more preferably in the range of from 0.63 mol/L to 0.78 mol/L, and still more preferably in the range of from 0.66 mol/L to 0.75 mol/L.

When the concentration of the alkaline catalyst is less than 0.6 mol/L, the dispersion of the core particles in the process of causing the formed core particles to grow is unstable and thus coarse aggregates such as secondary aggregates may be generated or gel-like shapes may be obtained, thereby deteriorating the particle size distribution.

On the other hand, when the concentration of the alkaline catalyst is more than 0.87 mol/L, the stability of the formed core particles is excessively large and thus core particles of a perfect spherical shape are formed, whereby it is difficult to obtain core particles of irregular shapes with an average circularity of equal to or less than 0.90.

The concentration of the alkaline catalyst means a concentration with respect to the alkaline catalyst solution (alkaline catalyst solvent including alcohol).

The particle forming process will be described below.

The particle forming process is a process of producing the sol-gel silica by independently supplying the tetraalkoxysilane and the alkaline catalyst to the alkaline catalyst solution and causing the tetraalkoxysilane to react (to carry out a hydrolysis reaction and a condensation reaction) in the alkaline catalyst solution.

In the particle forming process, the core particles are formed through the reaction of the tetraalkoxysilane at the initial time of supplying the tetraalkoxysilane (core particle forming process) and then the core particles grow (core particle growing process), whereby the sol-gel silica is produced.

Examples of the tetraalkoxysilane supplied to the alkaline catalyst solution include tetramethoxysilane, tetraethoxysilane, tetrapropoxysilane, and tetrabutoxysilane. Among these, tetramethoxysilane and tetraethoxysilane can be preferably used, in view of controllability of a reaction speed and the shape, particle diameter, and particle size distribution of the resultant sol-gel silica.

The amount of tetraalkoxysilane supplied is in the range of from 0.0055 mol/(mol·min) to 0.009 mol/(mol·min) with respect to alcohol in the alkaline catalyst solution.

This means that the tetraalkoxysilane is supplied with the rate of 0.0055 mol to 0.009 mol per minute with respect to 1 mol of alcohol used in the alkaline catalyst solution preparing process.

By setting the amount of tetraalkoxysilane supplied to the above-mentioned range, it is possible to easily produce sol-gel silica having an average particle diameter of 70 nm to 420 nm, an average circularity of equal to or less than 0.9, and a standard deviation of the circularity of greater than 0.2.

The particle diameter of the sol-gel silica depends on the type or reaction conditions of the tetraalkoxysilane, but primary particles with a particle diameter of equal to or more than 70 nm can be obtained by setting the total amount of tetraalkoxysilane supplied and used for the particle forming reaction to be for example, equal to or more than 0.756 mol with respect to 1 L of the sol-gel silica dispersion, and primary particles with a particle diameter of equal to or less than 420 nm can be obtained by setting the total amount of tetraalkoxysilane supplied to be equal to or less than 4.4 mol with respect to 1 L of the sol-gel silica dispersion.

When the amount of tetraalkoxysilane supplied is less than 0.0055 mol/(mol·min), it is relatively easy to prepare silica with a sharp distribution.

On the other hand, when the amount of tetraalkoxysilane supplied is equal to or more than 0.009 mol/(mol·min), the amount of tetraalkoxysilane supplied for the reaction is excessively large and the reaction system can be easily gelated to hinder the formation of the core particles or the growth of the particles.

The amount of tetraalkoxysilane supplied is preferably in the range of from 0.006 mol/(mol·min) to 0.0085 (mol·min) and more preferably in the range of from 0.006 mol/(mol·min) to 0.008 mol/(mol·min).

On the other hand, examples of the alkaline catalyst supplied to the alkaline catalyst solution include the same as described above. The alkaline catalyst to be supplied may be the same type as the alkaline catalyst included in the alkaline catalyst solution in advance or may be a type different therefrom. The same type of alkaline catalyst can be preferably used.

The amount of alkaline catalyst supplied is preferably in the range of from 0.1 mol to 0.4 mol per 1 mol of the total amount of tetraalkoxysilane supplied per minute, more preferably in the range of from 0.14 mol to 0.35 mol, and still more preferably in the range of from 0.18 mol to 0.30 mol.

When the amount of alkaline catalyst supplied is less than 0.1 mol, the dispersability of the core particles is unstable in the process of causing the formed core particles to grow, and coarse aggregates such as secondary aggregates are generated or the reaction system is gelated, thereby deteriorating the particle size distribution.

On the other hand, when the amount of alkaline catalyst supplied is more than 0.4 mol, the formed core particles are excessively stable. Accordingly, even when the core particles having a low circularity are formed in the process of forming the core particles, the formed core particles grow in a spherical shape in the process of causing the core particles to grow and thus sol-gel silica having a low circularity is not often obtained.

In the particle forming process, the tetraalkoxysilane and the alkaline catalyst are independently supplied to the alkaline catalyst solution. However, the supply method may be a continuous supply method or an intermittent supply method.

In the particle forming process, the temperature (the temperature at the time of supply) of the alkaline catalyst solution is, for example, in the range of from 5° C. to 50° C. and preferably in the range of from 15° C. to 40° C.

Through the above-mentioned processes, the sol-gel silica is obtained. In this state, the obtained sol-gel silica has a dispersion phase, but the solvent is removed therefrom to extract particles of the sol-gel silica.

Examples of the method of removing the solvent of the sol-gel silica dispersion include known methods such as 1) a method of removing the solvent through filtration, centrifugal separation, distillation, or the like and then drying the resultant by the use of a vacuum dryer, a shelf dryer, or the like and 2) a method of directly drying a slurry by the use of a fluidized bed dryer, a spray dryer, or the like. The drying temperature is not particularly limited, but is preferably equal to or lower than 200° C. When the drying temperature is higher than 200° C., the coupling of primary particles or the generation of coarse particles can be easily caused due to the condensation of a silanol group remaining on the surface of the sol-gel silica.

If necessary, coarse particles or aggregates are removed from the dried sol-gel silica through the use of pulverization and sieving. The pulverizing method is not particularly limited, but is performed using a dry pulverizer such as a jet mill, a vibration mill, a ball mill, and a pin mill. The sieving method is performed using a known machine such as a vibration sieving machine and a wind classifier.

The sol-gel silica obtained through the use of the above-mentioned method of producing sol-gel silica may be used after the surface of the sol-gel silica is hydrophobized with a hydrophobizing agent.

Examples of the hydrophobizing agent include known organic silicon compounds having an alkyl group (such as a methyl group, an ethyl group, a propyl group, and a butyl group). Specific examples thereof include silazane compounds (for example, silane compounds such as methyltrimethoxysilane, dimethyldimethoxysilane, trimethylchlorosilane, and trimethylmethoxysilane, hexamethyldisilazane, and tetramethylsilazane). One species of the examples or a combination of plural species may be used as the hydrophobizing agent.

Among these hydrophobizing agents, organic silicon compounds having a trimethyl group, such as trimethylmethoxysilane and hexamethyldisilazane can be suitably used.

The amount of hydrophobizing agent used is not particularly limited, but is preferably in the range of from 1% by weight to 100% by weight with respect to the sol-gel silica and more preferably in the range of from 5% by weight to 80% by weight, in view of the hydrophobization effect.

An example of the method of obtaining a hydrophobic sol-gel silica dispersion having been subjected to the hydrophobizing treatment using the hydrophobizing agent is a method of adding a necessary amount of hydrophobizing agent to the sol-gel silica dispersion, performing a hydrophobizing treatment on the sol-gel silica by causing the resultant to react in the temperature range of from 30° C. to 80° C., while stirring and obtaining the hydrophobic sol-gel silica dispersion. The hydrophobization reaction hardly progresses when the reaction temperature is lower than 30° C., and the gelation of the dispersion or the aggregation of the sol-gel silica can be easily caused due to the self-condensation of the hydrophobizing agent when the reaction temperature is higher than 80° C.

On the other hand, examples of the method of obtaining the hydrophobic sol-gel silica particles include a method of obtaining the hydrophobic sol-gel silica particles by preparing the hydrophobic sol-gel silica dispersion through the use of the above-mentioned method and then drying the dispersion through the use of the above-mentioned method, a method of obtaining the hydrophobic sol-gel silica particles by drying the sol-gel silica dispersion to obtain hydrophilic sol-gel silica particles and adding a hydrophobizing agent thereto to perform a hydrophobizing treatment, and a method of obtaining the hydrophobic sol-gel silica particles by drying the obtained hydrophobic sol-gel silica dispersion to obtain the hydrophobic sol-gel silica particles and adding a hydrophobizing agent thereto to perform a hydrophobizing treatment.

An example of the method of hydrophobizing the sol-gel silica particles is a method of stirring the hydrophilic sol-gel silica particles in a processing bath such as a Henschel mixer or a fluidized bed, adding a hydrophobizing agent thereto, heating the processing bath to gasify the hydrophobizing agent, and causing the hydrophobizing agent to react with the silanol group on the surfaces of the sol-gel silica particles. The processing temperature is not particularly limited, but is, for example, in the range of from 80° C. to 300° C. and preferably in the range of from 120° C. to 200° C.

According to the above-mentioned method of producing sol-gel silica, it is possible to obtain an external additive having an average particle diameter of 70 nm to 420 nm, an average circularity of equal to or less than 0.9, and a standard deviation of the circularity of greater than 0.2, that is, an external additive of small diameter and irregular shapes with a wide circularity distribution.

The above-mentioned external additive is preferably added in the range of from 0.5 part by weight to 5.0 parts by weight with respect to 100 parts by weight of toner particles to be described later, more preferably in the range of from 0.7 part by weight to 24.0 parts by weight, and still more preferably in the range of from 0.9 part by weight to 3.5 parts by weight.

Toner Particles

The toner particles will be described below.

The toner particles include at least a binder resin and may further include a colorant, a release agent, and other internal additives as needed.

Binder Resin

The binder resin is not particularly limited, but examples thereof include homopolymers including monomers such as styrens such as styrene, para-chlorostyrene, and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinylnitriles such as acrylonitrile and methacrylonitrile; vinyl ethers such as methyl vinyl ether and isobutyl vinyl ether; vinyl ketones such as methyl vinyl ketone, ethyl vinyl ketone, and isoprophenyl vinyl ketone; and polyolefins such as ethylene, propylene, and butadiene, copolymers including two or more monomers, and mixtures thereof. Examples thereof further include non-vinyl condensation resins such as an epoxy resin, a polyester resin, a polyurethane resin, a polyamide resin, a cellulose resin, and a polyether resin, mixtures of these with the vinyl resins, and graft polymers obtained by polymerizing the vinyl-based monomers in the copresence thereof.

The styrene resin, the (meth)acrylic resin, and the styrene-(meth)acryl copolymer resin can be obtained, for example, by applying a known method to styrene-based monomers and (meth)acrylate-based monomers alone or in combination. Here, the "(meth)acryl" includes any of "acryl" and "methacryl".

The polyester resin is obtained by selecting and combining very suitable components from dicarboxylic components and diol components and synthesizing the resultant through the use of known methods such as an ester exchange method or a polycondensation method.

When the styrene resin, the meth) acrylic resin, and the copolymer resin thereof are used as the binder resin, it is preferable that the weight-average molecular weight Mw be in the range of from 20,000 to 100,000 and the number-average molecular weight Mn be in the range of from 2,000 to 30,000. On the other hand, when the polyester resin is used as the binder resin, it is preferable that the weight-average molecular weight Mw be in the range of from 5,000 to 40,000 and the number-average molecular weight Mn be in the range of from 2,000 to 10,000.

The weight-average molecular weight is calculated by measuring a THE-soluble material with a THF solvent by the use of GPC HLC-8120 made by Tosoh Corporation and Column made by Tosoh Corporation, TSKgel Super HM-M (15 cm), and using a molecular weight calibration curve prepared by the use of a monodispersed polystyrene standard sample.

The glass transition temperature of the binder resin is preferably in the range of from 40° C. to 80° C. By setting the glass transition temperature to this range, it is easy to maintain the lowest fixing temperature.

The glass transition temperature is calculated as the peak temperature of an endothermic peak obtained through Differential Scanning Calorimetry (DSC)

Colorant

The colorant is not particularly limited but known colorants may be used. Examples thereof include carbon blacks such as furnace black, channel black, acetylene black, and thermal black, inorganic pigments such as red iron oxide, iron blue, and titanium oxide, azo pigments such as fast yellow, disazo yellow, pyrazolone red, chelate red, brilliant carmine, and parabrown, phthalocyanine pigments such as copper phthalocyanine and metal-free phthalocyanine, and condensed polycyclic pigments such as flavanthrone yellow, dibromoanthrone orange, perylene red, quinacridone red, and dioxazine violet.

Colorants subjected to surface treatment may be used if necessary or the colorants may be used along with a dispersant. Plural species of colorants may be combined.

The content of the colorant is preferably in the range of from 1% by weight to 30% by weight with respect to the total weight of the binder resin.

Release Agent

Examples of the release agent include hydrocarbon waxes; natural waxes such as carnauba wax, rice wax, and candelilla wax; synthetic or mineral and petroleum waxes such as montan wax; and ester waxes such as fatty acid ester and montanic acid ester. The release agent is not limited to these examples.

The melting point of the release agent is preferably equal to or higher than 50° C. and more preferably equal to or higher than 60° C., in view of storage stability. The melting point of the release agent is preferably equal to or lower than 110° C. and more preferably equal to or lower than 100°, in view of offset resistance.

The content of the release agent is preferably in the range of from 1% by weight to 15% by weight, more preferably in the range of from 2% by weight to 12% by weight, and still more preferably in the range of from 3% by weight to 10% by weight.

Other Internal Additives

Examples of other internal additives include a magnetic material, a charge-controlling agent, and inorganic powder.

Characteristics of Toner Particles

The characteristics of the toner particles will be described below.

The volume-average particle diameter of the toner particles is preferably in the range of from 3 μm to 9 μm and more preferably in the range of from 3 μm to 6 μm.

The measurement of the volume-average particle diameter is carried out by the use of Multisizer-II (made by Beckman Coulter Inc.) with an aperture diameter of 50 μm. At this time, the measurement is carried out after the toner is dispersed in an aqueous electrolyte solution (Isoton solution) by ultrasonic waves for 30 seconds or more.

Method of Producing Toner

A method of producing a toner according to this exemplary embodiment will be described below.

The toner particles may be produced using any of a dry production method (such as a kneading and pulverizing method) and a wet production method (such as an aggregation and coalescence method, a suspension and polymerization method, a melting, suspension, and granulation method, a melting and suspension method, and a melting, emulsification, aggregation and coalescence method). The method of producing the toner particles is not particularly limited and known production methods may be used.

The toner according to this exemplary embodiment is produced, for example, by adding the external additive to the obtained toner particles and mixing them. The mixture is carried out, for example, by the use of a V blender, a Henschel mixer, and a Lodige mixer. If necessary, coarse particles of the toner may be removed by the use of a vibration sieving machine, a wind classifier, or the like.

Electrostatic Charge Image Developer

The electrostatic charge image developer includes at least the toner according to this exemplary embodiment.

The electrostatic charge image developer according to this exemplary embodiment may be a single-component developer including only the toner according to this exemplary embodiment or may be a two-component developer including the toner and a carrier mixed with each other.

The carrier is not particularly limited and known carriers may be used. Examples of the carrier include resin-coated carriers, magnetic-dispersed carriers, and resin-dispersed carriers.

In the two-component developer, the mixing ratio (weight ratio) of the toner according to this exemplary embodiment and the carrier is preferably in the toner:carrier range of about 1:100 to about 30:100 and more preferably in the range of about 3:100 to about 20:100.

Image Forming Apparatus and Image Forming Method

An image forming apparatus and an image forming method according to this exemplary embodiment using the toner according to this exemplary embodiment will be described below.

The image forming apparatus according to this exemplary embodiment includes an image holding member, a charging unit that charges the surface of the image holding member, an electrostatic charge image forming unit that forms an electrostatic charge image on the surface of the image holding member, a developing unit that contains the electrostatic charge image developer according to this exemplary embodiment and that develops the electrostatic charge image formed on the surface of the image holding member with the electrostatic charge image developer to form a toner image, a transfer unit that transfers the toner image to a recording medium, a cleaning unit that has a cleaning blade cleaning the surface of the image holding member, and a fixing unit that fixes the toner image onto the recording medium.

In the image forming apparatus according to this exemplary embodiment, an image forming method including a charging process of charging the surface of an image holding member, an electrostatic charge image forming process of forming an electrostatic charge image on the surface of the charged image holding member, a developing process of developing the electrostatic charge image formed on the surface of the image holding member with the electrostatic charge image developer according to this exemplary embodiment to form a toner image, a transfer process of transferring the toner image to a recording medium, a cleaning process of cleaning the surface of the image holding member by the use of a cleaning blade, and a fixing process of fixing the toner image onto the recording medium.

When an electrophotographic photoreceptor is used as the image holding member, the formation of an image in the image forming apparatus according to this exemplary embodiment is performed, for example, as follows. First, the surface of the electrophotographic photoreceptor is charged by the use of a corotron charger or a contact charger and is then exposed to form an electrostatic charge image. Then, a developing roller having a developer layer formed on the surface thereof is brought close to or brought in contact with the electrophotographic photoreceptor to attach the toner to the electrostatic charge image and thus to form a toner image on the electrophotographic photoreceptor. The formed toner image is transferred to the surface of a recording medium such as paper by the use of a corotron charger or the like. The toner image transferred to the surface of the recording medium is fixed by a fixing device, whereby an image is formed on the recording medium.

In the image forming apparatus according to this exemplary embodiment, for example, a part including the developing unit may be a cartridge structure (a toner cartridge or a process cartridge) that is detachable from the image forming apparatus.

As the toner cartridge, for example, a toner cartridge that contains the electrostatic charge image developing toner according to this exemplary embodiment and that is detachable from the image forming apparatus can be suitably used.

As the process cartridge, for example, a process cartridge including the developing unit that contains the electrostatic charge image developer according to this exemplary embodiment and that develops the electrostatic charge image formed on the surface of the electrostatic latent image holding member with the electrostatic charge image developer to form a toner image and being detachable from the image forming apparatus can be suitably used.

An example of the image forming apparatus according to this exemplary embodiment will be described below, but the image forming apparatus is not limited to the example. The main parts shown in the drawing will be described and the other will not be described.

FIG. 1 is a diagram schematically illustrating the configuration of a four-tandem color image forming apparatus. The image forming apparatus shown in FIG. 1 includes first to fourth image forming units 10Y, 10M, 100, and 10K (the image forming unit) of an electrophotographic type outputting color images of yellow (Y), magenta (M), cyan (C), and black (K) based on color-separated image data. The image forming units (hereinafter, also simply referred to as "units") 10Y, 10M, 10C, and 10K are arranged at a predetermined interval in the horizontal direction. The units 10Y, 10M, 100, and 10K may be a process cartridge that is detachable from an image forming apparatus body.

Above the units 10Y, 10M, 10C, and 10K in the drawing, an intermediate transfer belt 20 as the intermediate transfer member extends over the units. The intermediate transfer belt 20 is wound on a driving roller 22 and a support roller 24 coming in contact with the inner surface of the intermediate transfer belt 20, which are disposed apart from each other, from left to right in the drawing, and travels in the direction from the first unit 10Y to the fourth unit 10K. The support roller 24 is impelled in a direction in which it gets apart from the driving roller 22 by a spring not shown or the like and thus a tension is given to the intermediate transfer belt 20 wound on both. An intermediate transfer member cleaning device 30 is disposed on the surface of the intermediate transfer belt 20 facing the image holding member so as to face the driving roller 22.

The developing devices (the developing units) 4Y, 4M, 4C, and 4K of the units 10Y, 10M, 10C, and 10K can be supplied with four color toners of yellow, magenta, cyan, and black contained in the toner cartridges 8Y, 8M, 8C and 8K, respectively.

Since the first to fourth units 10Y, 10M, 10C, and 10K have the same configuration, the first unit 10Y disposed upstream in the traveling direction of the intermediate transfer belt for forming a yellow image will be representatively described below. The parts equivalent to those of the first unit 10Y are referenced by reference signs corresponding to magenta (M), cyan (C), and black (K) instead of yellow (Y), and the second to fourth units 10M, 10C, and 10K will not be described.

The first unit 10Y includes a photoreceptor 1Y serving as the image holding member. Z charging roller 2Y charging the surface of the photoreceptor 1Y to a predetermined potential, an exposing device (the electrostatic charge image forming unit) 3 exposing the charged surface with a laser beam 3Y based on a color-separated image signal to form an electrostatic charge image, a developing device (the developing unit) 4Y supplying a charged toner to the electrostatic charge image to develop the electrostatic charge image, a primary transfer roller (the primary transfer unit) 5Y transferring the developed toner image to the intermediate transfer belt 20, and a photoreceptor cleaning device (the cleaning unit) 6Y having a cleaning blade 6-1Y removing the toner remaining on the surface of the photoreceptor 1Y after the primary transfer are sequentially arranged around the photoreceptor 1Y.

The primary transfer roller 5Y is disposed inside the intermediate transfer belt 20 and is located at a position facing the photoreceptor 1Y. The primary transfer rollers 5Y, 5M, 5C, and 5K are connected to bias power sources (not shown) applying a primary transfer bias. The bias power sources vary the transfer bias to be applied to the primary transfer rollers under the control of a control unit not shown.

The operation of forming a yellow image by the use of the first unit 10Y will be described below. Before starting the operation, the surface of the photoreceptor 1Y is charged to a potential of about −600 V to −800 V by the charging roller 2Y.

The photoreceptor 1Y has a structure in which a photosensitive layer is stacked on a conductive base (with volume resistivity of $1\times10^{-6}$ Ωcm or less at 20° C.). The photosensitive layer has a characteristic that the resistance is normally high (which is a same resistance as that of a normal resin) but the resistivity of a part irradiated with a laser beam is changed when the laser beam 3Y is applied thereto. The exposing device 3 outputs the laser beam 3Y to the charged surface of the photoreceptor 1Y on the basis of yellow image data sent from the control unit not shown. The laser beam 3Y is applied to the photosensitive layer on the surface of the photoreceptor 1Y and thus an electrostatic charge image of a yellow print pattern is formed on the surface of the photoreceptor 1Y.

The electrostatic charge image is an image to be formed on the surface of the photoreceptor 1Y by the charging and is a so-called negative latent image which is formed by lowering the resistivity of the irradiated part of the photosensitive layer with the laser beam 3Y to cause charges to flow on the surface of the photoreceptor 1Y and causing the charges to remain in the part not irradiated with the laser beam 3Y.

The electrostatic charge image formed on the photoreceptor 1Y in this way rotates to a predetermined developing position with the rotation of the photoreceptor 1Y. At the developing position, the electrostatic charge image on the photoreceptor 1Y is visualized (changed to a developed image) by the developing device 4Y.

For example, the electrostatic charge image developer according to this exemplary embodiment including at least a yellow toner and a carrier is contained in the developing device 4Y. The yellow toner is frictionally charged by stirring in the developing device 4Y and is supported on a developer roller (the developer supporting member) with electric charges having the same polarity (negative (−) polarity) as that of the electric charges on the photoreceptor 1Y. By causing the surface of the photoreceptor 1Y to pass through the developing device 4Y, the yellow toner is electrostatically attached to an erased latent image part on the surface of the photoreceptor 1Y to develop the latent image with the yellow toner. The photoreceptor 1Y having a yellow toner image formed thereon continuously travels at a predetermined speed to carry the developed toner image on the photoreceptor 1Y to a predetermined primary transfer position.

When the yellow toner image on the photoreceptor 1Y is transported to the primary transfer position, a predetermined primary transfer bias is applied to the primary transfer roller 5Y and an electrostatic force acting from the photoreceptor 1Y to the primary transfer roller 5Y is applied to the toner image, whereby the toner image on the photoreceptor 1Y is transferred to the intermediate transfer belt 20. The transfer bias applied at this time has the (+) polarity opposite to the polarity (−) of the toner and is controlled to about +10 μA in the first unit 10Y by the control unit (not shown).

On the other hand, the toner remaining on the photoreceptor 1Y is removed and recovered by the cleaning blade 6-1Y of the photoreceptor cleaning device 6Y.

The primary transfer biases applied to the primary transfer rollers 5M, 5C, and 5K of the second unit 10M and the subsequent units thereof are controlled similarly to the first unit.

In this way, the intermediate transfer belt 20 to which the yellow toner image is transferred in the first unit 10Y is sequentially transported through the second to fourth units 10M, 100, and 10K and the toner images of the colors are multiply transferred to form a superimposed toner image.

The intermediate transfer belt 20 to which four color toner images are multiply transferred by the first to fourth units reaches a secondary transfer part formed by the intermediate transfer belt 20, the support roller 24 in contact with the inner surface of the intermediate transfer belt 20, and a secondary transfer roller (the secondary transfer unit) 26 disposed on the image supporting surface of the intermediate transfer belt 20. On the other hand, a recording sheet (the transfer medium) P is fed to a nip in which the secondary transfer roller 26 and the intermediate transfer belt 20 come in pressing contact with each other at a predetermined time by the use of a feed mechanism and a predetermined secondary transfer bias is applied to the support roller 24. The transfer bias applied at this time has the same (−) polarity as the polarity (−) of the toner and an electrostatic force acting from the intermediate transfer belt 20 to the recording sheet P is applied to the superimposed toner image, whereby the superimposed toner image on the intermediate transfer belt 20 is transferred to the recording sheet P. In addition, the secondary transfer bias is determined depending on the resistance detected by a resistance detector (not shown) detecting the resistance of the second transfer part and is voltage-controlled.

Thereafter, the recording sheet P is fed to the pressing part (nip part) between a pair of fixing rolls in the fixing device (the roll-like fixing unit) 28, and the superimposed toner image is heated to melt the color-superimposed toner image and is fixed to the recording sheet P.

Examples of the transfer medium onto which a toner image is transferred include regular sheets of paper and OHP sheets used for an electrophotographic copier or printer.

When it is intended to further improve the smoothness of the image surface after the fixation, the surface of the transfer medium is preferably as smooth as possible, and a coated sheet of paper or a printing art sheet of paper in which the surface of a regular sheet of paper is coated with a resin or the like can be very suitably used.

The recording sheet P to which the color image has been fixed is transported to a discharge unit and a series of color image forming operations are ended.

The image forming apparatus has the configuration in which a superimposed toner image is transferred to a recording sheet P via the intermediate transfer belt 20, but is not limited to this configuration. The image forming apparatus may have a configuration in which a toner image is transferred directly to a recording sheet from the photoreceptor.

Process Cartridge and Toner Cartridge

Figure 2:
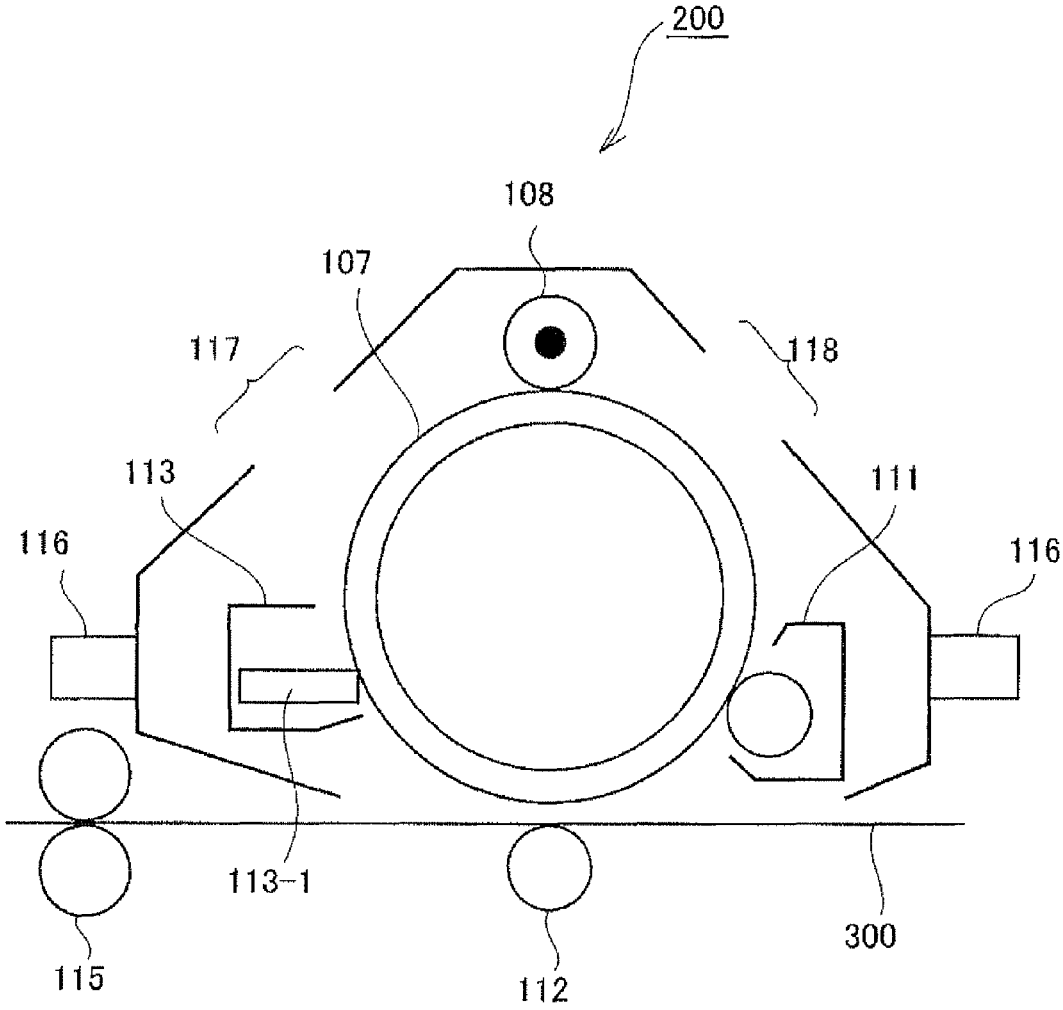
FIG. 2 is a diagram schematically illustrating the configuration of a process cartridge according to the exemplary embodiment of the invention.

FIG. 2 is a configurational diagram schematically illustrating a suitable example of the process cartridge containing the electrostatic charge image developer according to this exemplary embodiment. In the process cartridge 200, a charging roller 108, a developing device 111, a photoreceptor cleaning device 113 including a cleaning blade 113-1, an exposure opening 118, and an opening for erasing exposure 117 are combined with a photoreceptor 107 to form a body by the use of an attachment rail 116. Reference sign 300 in FIG. 2 represents a transfer medium.

The process cartridge 200 is detachable from an image forming apparatus body including a transfer device 112, a fixing device 115, and other constituent parts not shown.

The process cartridge 200 shown in FIG. 2 includes the photoreceptor 107, the charging device 108, the developing device 111, the cleaning device 113, the exposure opening 118, and the opening for erasing exposure 117, but these elements may be selectively combined. The process cartridge according to this exemplary embodiment may include at least one element selected from the group consisting of the charging device 108, the developing device 111, and the cleaning device (the cleaning unit) 113, the exposure opening 118, and the opening for erasing exposure 117, in addition to the photoreceptor 107.

A toner cartridge according to this exemplary embodiment will be described below. The toner cartridge according to this exemplary embodiment is a toner cartridge that contains the electrostatic charge image developing toner and that is detachable from the image forming apparatus.

The image forming apparatus shown in FIG. 1 is an image forming apparatus having the configuration in which the toner cartridges 8Y, 8M, 8C, and 8K are detachable therefrom. The developing devices 4Y, 4M, 4C, and 4K are connected to the toner cartridges corresponding to the developing devices (colors) via toner supply pipes not shown. When each toner cartridge is short of the toner, the corresponding toner cartridge is replaced.

EXAMPLES

This exemplary embodiment will be described below in more detail with reference to examples, but this exemplary embodiment is not limited to the examples. "part" and "%" mean "parts by weight" and "% by weight", respectively, as long as they are not differently defined.

Preparation of Toner Particle 1

—Preparation of Resin Particle Dispersion 1

Styrene (made by Wako Pure Chemical Industries, Ltd.): 320 parts n-butyl methacrylate (made by Wako Pure Chemical Industries, Ltd.): 80 parts β-carboxyethyl acrylate (Rhodia Nicca Ltd.): 9 parts 1',10-decanediol diacrylate (made by Shin Nakamura Chemical Co., Ltd.): 1.5 parts Dodecane diol (made by Wako Pure Chemical Industries, Ltd.): 2.7 parts A solution in which 4 parts of an anionic surfactant Dow Fax (made by Dow Chemical Co.) is dissolved in 550 parts of ion-exchange water is added to the mixture in which the above components are mixed and dissolved, the resultant is dispersed and emulsified in a flask, and 50 parts of ion-exchange water in which 6 parts of ammonium persulphate is dissolved is input thereto while slowly stirring and blending the resultant for 10 minutes. Then, nitrogen substitution is performed in the flask, the flask is heated to 70° C. with an oil bath while stirring the solution in the flask, and the emulsification and polymerization is continued for 5 hours, whereby anionic Resin Particle Dispersion 1 with a solid content of 41% is obtained.

The resin particles in Resin Particle Dispersion 1 have a median particle diameter of 196 nm, a glass transition temperature of 51.5° C., and a weight-average molecular weight Mw is 32400.

Preparation of Resin Particle Dispersion 2

Styrene (made by Wako Pure Chemical Industries, Ltd.): 280 parts n-butyl acrylate (made by Wako Pure Chemical Industries, Ltd.): 120 parts β-carboxyethyl acrylate (Rhodia Nicca Ltd.): 9 parts A solution in which 1.5 parts of an anionic surfactant Dow Fax (made by Dow Chemical Co.) is dissolved in 550 parts of ion-exchange water is added to the mixture in which the above components are mixed and dissolved, the resultant is dispersed and emulsified in a flask, and 50 parts of ion-exchange water in which 0.4 part of ammonium persulphate is dissolved is input thereto while slowly stirring and blending the resultant for 10 minutes. Then, nitrogen substitution is performed in the flask, the flask is heated to 70° C. with an oil bath while stirring the solution in the flask, and the emulsification and polymerization is continued for 5 hours, whereby anionic Resin Particle Dispersion 2 with a solid content of 42% is obtained.

The resin particles in Resin Particle Dispersion 2 have a median particle diameter of 150 nm, a glass transition temperature of 53.2° C., a weight-average molecular weight Mw is 41000, and a number-average molecular weight Mn of 25000.

—Preparation of Colorant Particle Dispersion 1

C.I. Pigment Yellow 74 pigment: 30 parts

Anionic surfactant (Newrex R, made by Nippon Oil and Fats Co., Ltd.): 2 parts

Ion-exchange water: 220 parts

These components are mixed and are preliminarily dispersed by the use of a homogenizer (ULTRA-TURRAX, made by IKA Co., Ltd.), and the resultant is then dispersed with a pressure of 245 MPa for 15 minutes by the use of Ultimaizer (which is a counter collision type wet pulverizer, made by Sugino Machine Limited), whereby Colorant Particle Dispersion 1 with a median particle diameter of the colorant particles of 169 nm and a solid content of 22.0% is obtained.

—Preparation of Release Agent Particle Dispersion 1

Paraffin wax HNP 9 (with a melting temperature of 75° C., made by Nippon Seiro Co., Ltd.): 45 parts Cationic surfactant Neogen RK (Dai-ichi Kogyo Seiyaku Co., Ltd.): 5 parts Ion-exchange water: 200 parts The mixture of these components is heated to 100° C., is dispersed by the use of ULTRA-TURRAX T50 (made by INA Co., Ltd.), and is then dispersed by the use of a pressure-ejection type Gaulin Homogenizer, whereby Release Agent Particle Dispersion 1 with a median particle diameter of the release agent particles of 196 nm and a solid content of 22.0% is obtained.

Resin Particle Dispersion 1: 106 parts

Resin Particle Dispersion 2: 36 parts

Colorant Particle Dispersion 1: 30 parts

Release Agent Particle Dispersion 1: 91 parts

These components are mixed and dispersed in a round stainless flask by the use of ULTRA-TURRAX T50 (made by IKA Co., Ltd.) to obtain a solution.

0.4 part of polyaluminum chloride is added to the resultant solution to prepare core aggregated particles and the resultant is continuously dispersed by the use of the ULTRA-TURRAX. The solution in the flask is stirred and heated to 49° C. by the use of a heating oil bath, the resultant is maintained at 49° C. for 60 minutes, and 36 parts of Resin particle Dispersion 1 is added thereto, whereby core/shell aggregated particles are prepared. Thereafter, a 0.5 mol/L aqueous solution of sodium hydroxide is added thereto to adjust the pH of the solution to 5.6, the stainless flask is sealed, the resultant solution is continuously stirred and heated to 96° C. by the use of a magnetic seal, and the resultant is maintained for 5 hours and is then cooled, whereby yellow toner particles are obtained.

The toner particles dispersed in the solution are filtrated and is washed with ion-exchange water, and is then subjected to solid-liquid separation through the use of Nutsche suction filtration. The resultant is re-dispersed in 3 L, of ion-exchange water of 40° C. and is stirred and washed at 300 rpm for 15 minutes. This process is repeated five times, the solid-liquid separation is performed thereon through the use of Nutsche suction filtration using a No5A filter paper when the pH of the filtrate is 7.01, the electric conductivity is 9.8 μS/cm, and the surface tension is 71.1 Nm, and the resultant solid is dried in vacuum for 12 hours, whereby toner particles with a volume-average particle diameter of 6.4 μm are obtained.

Preparation of External Addtive 1

Alkaline Catalyst Solution Preparing Process (Preparation of Alkaline Catalyst Solution (1))

300 parts of methanol and 47.8 parts of 10% ammonia water are input to a glass reaction vessel with a volume of 3 L including a metal stirring rod, a drop nozzle (a micro tube pump made of Teflon (registered trademark)), and a thermometer, and are stirred and blended, whereby Alkaline Catalyst Solution (1) is obtained. At this time, the amount of ammonia catalyst (amount of $NH_3$ ($NH_3$ [mol]/(ammonia water+methanol) [L]) of Alkaline Catalyst Solution (1) is 0.72 mol/L.

Particle Forming Process (Preparation of Sol-gel Silica Dispersion (1))

The temperature of Alkaline Catalyst Solution (1) is adjusted to 25° C. and Alkaline Catalyst Solution (1) is subjected to nitrogen substitution. Thereafter, 400 parts of tetramethoxysilane (TMOS) and 260 parts of ammonia water with a catalyst ($NH_3$) concentration of 4.44% are simultaneously dropped by the following amounts supplied while stirring Alkaline Catalyst Solution (1), whereby a dispersion of sol-gel silica (Sol-gel Silica Dispersion (1)) is obtained.

The amount of tetramethoxysilane (TMOS) supplied is set to 8.4 g/min with respect to the total mol number of methanol in Alkaline Catalyst Solution (1), that is, 0.0059 mol/(mol·min).

The amount of 4.44% ammonia water supplied is set to 3.97 g/min with respect to the total amount of tetraalkoxysilane (0.0552 mol/min) supplied per minute. This corresponds to 0.258 mol/min with respect to 1 mol of the total amount of tetraalkoxysilane supplied per minute.

Process of Hydrophobizing Sol-gel Silica 5.59 parts of trimethylsilane is added to 200 parts (with a solid content of 13.985%) of Sol-gel Silica Dispersion (1) to perform the hydrophobizing treatment. Thereafter, by heating and drying the resultant at 65° C. by the use of a hot plate, Hydrophobic Sol-gel Silica (1) with shape irregularity is generated.

Hydrophobic Sol-gel Silica (1) is used as External Additive 1.

Preparation of External Additives 2 to 13

Alkaline catalyst solutions are prepared in the same way as producing External Additive 1, except that the amount of methanol and the amount of 10% ammonia water are replaced with the amounts described in Table 1 in the alkaline catalyst solution preparing process. The amounts of $NH_3$ are described in "amount of $NH_3$ in 10% ammonia water" in Table 1.

Sol-gel silica dispersions are prepared in the same way as producing External Additive 1, except that the above-described alkaline catalyst solution is used and the amount of tetramethoxysilane (TMOS) added to the alkaline catalyst solution and the amount of TMOS supplied and the concentration, amount, and supply amount of the catalyst ($NH_3$) of ammonia water added to the alkaline catalyst solution are replaced with the values described in Table 1 in the alkaline catalyst solution preparing process.

The hydrophobizing treatment and the drying process are performed using the obtained sol-gel silica dispersions in the same way as producing External Additive 1, whereby Hydrophobic Sol-gel Silicas 2 to 13 with shape irregularity are produced.

Hydrophobic Sol-gel Silicas 2 to 13 are used as External Additives 2 to 13.

The amount of tetramethoxysilane added to the alkaline catalyst solution is changed to the values described in "parts by weight" of "TMOS" of "total amount added" in Table 1 and the amount of tetramethoxysilane supplied is changed to the values described in "TMOS" of "amount supplied (g/min)" in Table 1.

The concentration of the catalyst ($NH_3$) of the ammonia water added to the alkaline catalyst solution is changed to the values described in "concentration of $NH_3$" of "ammonia water" of "total amount added" in Table 1, the amount of ammonia water is changed to the values described in "parts by weight" of "ammonia water" of "total amount added" in Table 1, and the amount of ammonia water supplied is changed to the values described in "ammonia water" of "amount supplied (g/min)".

Here, regarding the amount of TMOS supplied, the values relative to the total mol number of methanol in the alkaline catalyst solution are described "amount of TMOS" of "amount supplied (relative amount)" in Table 1. Regarding the amount of ammonia water supplied, the values relative to 1 mol of the total amount of tetramethoxysilane supplied per minute are described in "amount of $NH_3$" of "amount supplied (relative amount)" in Table 1.

Example 1

Preparation of Toner 1

2.0 parts of External Additive 1 are added to 100 parts of Toner Particle 1 by the use of a Henschel mixer, whereby Toner 1 is prepared.

As the result of image analysis of Toner 1 through the above-mentioned method, the average particle diameter of the external additive (sol-gel silica) is 75 nm, the average circularity is 0.77, and the standard deviation of the circularity is 0.21.

Preparation of Developer 1

4 parts of Toner 1 and 96 parts of the below-described carrier are stirred at 40 rpm for 20 minutes using a V blender and the resultant is sieved by the use of a sieve with a mesh of 250 μm, whereby Developer 1 is prepared.

Preparation of Carrier 1

Ferrite particle (with an average particle diameter of 50 μm): 100 parts

Toluene: 14 parts

Styrene-methylmethacrylate copolymer (with a component ratio of 90/10): 2 parts

Carbon black (R330, made by Cabot Corp.): 0.2 part The components other than the ferrite particles are stirred and dispersed with a stirrer for 10 minutes to prepare a coating solution, and the coating solution and the ferrite particles are input to a vacuum degassing kneader and are stirred at 60° C. for 30 minutes and are then degassed and dried while raising the temperature and lowering the pressure, whereby Carrier 1 is prepared.

Evaluation

The obtained developers are evaluated as follows. The evaluation results are shown in Table 2.

The resultant developers are contained in a developing device of an image forming apparatus DocuCentre Color 400 (made by Fuji Xerox Co., Ltd.). An OHP sheet is attached to the top of the developing device of the image forming apparatus, an image with an image density of 1% is printed on 10,000 sheets of A4 paper under an environment of 10° C. and 10% RH (low-temperature and low-humidity environment) with the use of each developer, the curling of a blade, the generation of abnormal noise, and the generation of a color streak are evaluated. The results are shown in Table 2.

Evaluation of Curling of Blade

The curling of a blade at the initial time of printing (up to 100 sheets) is observed and evaluated with a naked eye. The evaluation criterion is as follows.

A: The curling of a cleaning blade is not observed.

C: the curling of a cleaning blade is observed.

Evaluation of Abnormal Noise

Regarding the abnormal noise (squeal) of a cleaning blade, at the initial time (after printing on one to 10 sheets) and after printing on 10,000 sheets, the image holding member is charged and rotated in a non-developed state at a process speed of 194 mm/s for 10 minutes. Thereafter, the process speed is changed to 104 mm/s and the abnormal noise is evaluated.

The evaluation criterion is as follows. G1, G2, or G3 does not cause any problem in practice.

G1: Abnormal noise is not generated.

G2: Small squeal is generated just after deceleration, but disappears after printing on several sheets (a level which is heard by opening the front surface of the image forming apparatus and bring an ear close to the apparatus, and is negligible in a normal situation).

G3: Small squeal is generated (a level which is heard by opening the front surface of the image forming apparatus and bring an ear close to the apparatus, and is negligible in a normal situation).

G4: Squeal is generated at the time of deceleration and does not disappear thereafter (a level which is heard in a normal operation).

Evaluation of Color Streak

Thereafter, after an image density is set to 80% and an image is printed on 1000 sheets, the color streak is evaluated.

The evaluation criterion is as follows.

A: No color streak is generated and good image quality is obtained to the final.

B: A slight color streak is generated but is seen by concentrating an eye thereon, which is an allowable level.

C: Image quality degradation due to a color streak is generated.

Examples 2 to 8 and Comparative Example 1 to 5

Toners and developers are prepared in the same way as in Example 1, except that External Additive 1of Example 1 is replaced with the external additives described in Table 1, and then are evaluated in the same way as Example 1. The results are shown in Table 2.

TABLE 1

| | | Preparation process | | | Particle forming process | | | | | | |
|---|---|---|---|---|---|---|---|---|---|---|---|
| | | Added components | | | | | | | | Amount of supplied (relative amount) | |
| | | methanol | 10% ammonia water | | Total amount added | | | Amount of supplied (g/min) | | Amount of $NH_3$ | Amount of TMOS |
| | | Parts | | Amount | TMOS | Ammonia water | | | Ammonia | (mol/min) | (mol/mol · min) |
| | | by weight | Parts by weight | of $NH_3$ (mol/L) | Parts by weight | Parts by weight | Concentration of $NH_3$ | TMOS (g/min) | water (g/min) | (relative to TMOS) | (relative to methanol) |
| Ex. 1 | External Additive 1 | 300 | 47.8 | 0.72 | 400 | 260 | 4.44 | 8.4 | 3.97 | 0.258 | 0.0059 |
| Ex. 2 | External Additive 2 | 300 | 51.0 | 0.76 | 470 | 250 | 4.44 | 10.0 | 5.38 | 0.211 | 0.007 |
| Ex. 3 | External Additive 3 | 300 | 55.3 | 0.82 | 485 | 230 | 4.44 | 10.63 | 6.38 | 0.188 | 0.0075 |

TABLE 1-continued

| | | Preparation process | | | Particle forming process | | | | | | |
|---|---|---|---|---|---|---|---|---|---|---|---|
| | | Added components | | | | | | | | Amount of supplied (relative amount) | |
| | | methanol | 10% ammonia water | | Total amount added | | | Amount of supplied (g/min) | | Amount of $NH_3$ | Amount of TMOS |
| | | Parts | | Amount | TMOS | Ammonia water | | | Ammonia | (mol/min) | (mol/mol · min) |
| | | by weight | Parts by weight | of $NH_3$ (mol/L) | Parts by weight | Parts by weight | Concentration of $NH_3$ | TMOS (g/min) | water (g/min) | (relative to TMOS) | (relative to methanol) |
| Ex. 4 | External Additive 4 | 300 | 51.6 | 0.77 | 450 | 250 | 4.44 | 9.82 | 5.53 | 0.22 | 0.0069 |
| Ex. 5 | External Additive 5 | 250 | 50.5 | 0.76 | 380 | 295 | 4.44 | 8.0 | 2.69 | 0.309 | 0.0067 |
| Ex. 6 | External Additive 6 | 300 | 50.9 | 0.76 | 570 | 230 | 4.44 | 11.1 | 7.08 | 0.16 | 0.0078 |
| Ex. 7 | External Additive 7 | 280 | 58.5 | 0.83 | 450 | 270 | 4.44 | 11.5 | 5.81 | 0.238 | 0.0086 |
| Com. Ex. 1 | External Additive 8 | 300 | 47.5 | 0.72 | 450 | 270 | 4.44 | 8.51 | 4.96 | 0.238 | 0.006 |
| Com. Ex. 2 | External Additive 9 | 300 | 56.4 | 0.83 | 570 | 200 | 4.44 | 11.33 | 6.8 | 0.139 | 0.008 |
| Com. Ex. 3 | External Additive 10 | 300 | 51.2 | 0.77 | 250 | 300 | 4.44 | 2.8 | 2.83 | 0.476 | 0.002 |
| Com. Ex. 4 | External Additive 11 | 300 | 51.5 | 0.77 | 400 | 250 | 4.44 | 5.4 | 4.07 | 0.248 | 0.0038 |
| Com. Ex. 5 | External Additive 12 | 300 | 50.8 | 0.76 | 450 | 270 | 4.44 | 7.56 | 4.53 | 0.238 | 0.0053 |
| Ex. 8 | External Additive 13 | 300 | 52.3 | 0.78 | 600 | 200 | 4.0 | 10.1 | 8.08 | 0.119 | 0.0071 |

TABLE 2

| | Average diameter (nm) | Average circularity | Standard deviation of circularity | Curling of blade | Abnormal noise (initial) | Abnormal noise (after printing on 10,000 sheets) | Evaluation of color streak |
|---|---|---|---|---|---|---|---|
| Ex. 1 | 75 | 0.77 | 0.21 | A | G2 | G2 | B |
| Ex. 2 | 212 | 0.67 | 0.25 | A | G1 | G1 | A |
| Ex. 3 | 395 | 0.60 | 0.24 | A | G2 | G1 | A |
| Ex. 4 | 234 | 0.66 | 0.24 | A | G1 | G1 | A |
| Ex. 5 | 188 | 0.86 | 0.22 | A | G1 | G1 | B |
| Ex. 6 | 204 | 0.55 | 0.23 | A | G2 | G3 | A |
| Ex. 7 | 277 | 0.64 | 0.28 | A | G2 | G3 | A |
| Com. Ex. 1 | 60 | 0.70 | 0.21 | A | G2 | G4 | C |
| Com. Ex. 2 | 440 | 0.57 | 0.27 | A | G4 | G4 | C |
| Com. Ex. 3 | 220 | 0.95 | 0.05 | A | G1 | G3 | C |
| Com. Ex. 4 | 230 | 0.75 | 0.10 | C | G4 | G4 | C |
| Com. Ex. 5 | 200 | 0.73 | 0.18 | C | G2 | G4 | C |
| Ex. 8 | 264 | 0.48 | 0.21 | C | G3 | G3 | B |

It can be seen from the results of Table 2 that the generation of a color streak, the curling of a cleaning blade, and the generation of abnormal noise are more suppressed in Example 1 to 7, compared with the comparative examples.

In Example 8, the generation of a color streak and the generation of abnormal noise are more suppressed, compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and an external additive having an average particle diameter of from about 70 nm to about 420 nm, an average circularity of equal to or less than about 0.9, and a standard deviation of the circularity of greater than 0.2, wherein the circularity of the external additive is calculated by the following expression:

$$\text{circularity}=[2\times(A\pi)^{1/2}]/PM$$

where, in the expression, A is a projection area of an external additive particle, and PM is the perimeter of the external additive particle.

2. The electrostatic charge image developing toner according to claim 1, wherein the average circularity of the external additive is equal to or more than about 0.5.

3. The electrostatic charge image developing toner according to claim 1, wherein the external additive is a sol-gel silica.

4. The electrostatic charge image developing toner according to claim 1, wherein the external additive is a sol-gel silica treated with an organic silicon compound as a hydrophobizing agent.

5. An electrostatic charge image developer comprising the electrostatic charge image developing toner according to claim 1.

6. An electrostatic charge image developer comprising the electrostatic charge image developing toner according to claim 2.

7. A toner cartridge containing the electrostatic charge image developing toner according to claim 1 and being detachable from an image forming apparatus.

8. A process cartridge comprising a developing unit that contains the electrostatic charge image developer according to claim 5 and that develops an electrostatic charge image formed on the surface of an image holding member with the electrostatic charge image developer to form a toner image and being detachable from an image forming apparatus.

9. An image forming apparatus comprising:

an image holding member;

a charging unit that charges the surface of the image holding member;

an electrostatic charge image forming unit that forms an electrostatic charge image on the surface of the image holding member;

a developing unit that contains the electrostatic charge image developer according to claim 5 and that develops the electrostatic charge image with the electrostatic charge image developer to form a toner image;

a transfer unit that transfers the toner image to a recording medium;

a cleaning unit that has a cleaning blade cleaning the surface of the image holding member; and a fixing unit that fixes the toner image onto the recording medium.

10. An image forming method comprising:

charging the surface of an image holding member;

forming an electrostatic charge image on the surface of the image holding member;

developing the electrostatic charge image with the electrostatic charge image developer according to claim 5 to form a toner image;

transferring the toner image to a recording medium;

cleaning the surface of the image holding member by the use of a cleaning blade; and fixing the toner image onto the recording medium.

* * * * *